US008159136B2

(12) United States Patent
DeVincentis et al.

(10) Patent No.: US 8,159,136 B2
(45) Date of Patent: Apr. 17, 2012

(54) FREQUENCY TUNABLE RESONANT CAVITY FOR USE WITH AN ELECTRODELESS PLASMA LAMP

(75) Inventors: Marc DeVincentis, Palo Alto, CA (US); Sandeep Mudunuri, Sunnyvale, CA (US)

(73) Assignee: Luxim Corporation, Sunnyvale, CA (US)

( * ) Notice: Subject to any disclaimer, the term of this patent is extended or adjusted under 35 U.S.C. 154(b) by 752 days.

(21) Appl. No.: 12/069,185

(22) Filed: Feb. 7, 2008

(65) Prior Publication Data

US 2008/0258627 A1 Oct. 23, 2008

Related U.S. Application Data

(60) Provisional application No. 60/888,729, filed on Feb. 7, 2007.

(51) Int. Cl.
*H01J 7/46* (2006.01)

(52) U.S. Cl. ..... 315/39; 315/39.61; 333/208

(58) Field of Classification Search ..... 315/39, 315/39.55, 39.5, 111.21, 111.71; 313/490–492, 313/582–587, 231.31, 231.61; 333/206, 333/208, 209, 239, 248
See application file for complete search history.

(56) References Cited

U.S. PATENT DOCUMENTS

| | | | | |
|---|---|---|---|---|
| 3,787,705 | A | 1/1974 | Bolin et al. | |
| 3,826,950 | A * | 7/1974 | Hruda et al. | 315/267 |
| 3,872,349 | A * | 3/1975 | Spero et al. | 315/39 |
| 4,001,631 | A | 1/1977 | McNeill et al. | |
| 4,206,387 | A | 6/1980 | Kramer et al. | |
| 4,485,332 | A | 11/1984 | Ury et al. | |
| 4,498,029 | A | 2/1985 | Yoshizawa et al. | |
| 4,633,140 | A | 12/1986 | Lynch et al. | |
| RE32,626 | E | 3/1988 | Yoshizawa et al. | |
| 4,749,915 | A | 6/1988 | Lynch et al. | |
| 4,795,658 | A | 1/1989 | Kano et al. | |
| 4,887,192 | A | 12/1989 | Simpson et al. | |
| 4,950,059 | A | 8/1990 | Roberts | |
| 4,975,625 | A | 12/1990 | Lynch et al. | |
| 4,978,891 | A | 12/1990 | Ury | |
| 5,039,903 | A | 8/1991 | Farrall | |
| 5,070,277 | A | 12/1991 | Lapatovich | |
| 5,072,157 | A | 12/1991 | Greb et al. | |

(Continued)

FOREIGN PATENT DOCUMENTS

JP 8148127 6/1996

(Continued)

OTHER PUBLICATIONS

"Chapter 4—Cavity Resonators, Army Technical Manual, TM 11-673—Generation and Transmission of Microwave Energy", (Jun. 1953), 12 pgs.

(Continued)

*Primary Examiner* — Jacob Y Choi
*Assistant Examiner* — Jimmy Vu
(74) *Attorney, Agent, or Firm* — Schwegman, Lundberg & Woessner, P.A.

(57) ABSTRACT

A plasma lamp is described with resonant frequency tuning capability and associated methods for tuning. One tuning method allows plasma lamp manufacturer to set the frequency of lamps to several discrete predetermined values. For example, most lamps that are near the center of a frequency distribution can be tuned to a nominal value such as 918.7 MHz. Other frequencies can also be tuned to increase manufacturing yield and improve lamp performance.

12 Claims, 7 Drawing Sheets
(1 of 7 Drawing Sheet(s) Filed in Color)

U.S. PATENT DOCUMENTS

| | | | | |
|---|---|---|---|---|
| 5,084,801 | A | 1/1992 | El-Hamamsy et al. | |
| 5,086,258 | A | 2/1992 | Mucklejohn et al. | |
| 5,361,274 | A | 11/1994 | Simpson et al. | |
| 5,438,242 | A | 8/1995 | Simpson | |
| 5,448,135 | A | 9/1995 | Simpson | |
| 5,498,937 | A | 3/1996 | Korber et al. | |
| 5,525,865 | A | 6/1996 | Simpson | |
| 5,594,303 | A | 1/1997 | Simpson et al. | |
| 5,786,667 | A | 7/1998 | Simpson et al. | |
| 5,910,710 | A | 6/1999 | Simpson | |
| 5,910,754 | A | 6/1999 | Simpson et al. | |
| 5,923,116 | A | 7/1999 | Mercer et al. | |
| 6,020,800 | A * | 2/2000 | Arakawa et al. | 333/208 |
| 6,031,333 | A | 2/2000 | Simpson | |
| 6,046,545 | A * | 4/2000 | Horiuchi et al. | 315/39 |
| 6,049,170 | A | 4/2000 | Hochi et al. | |
| 6,137,237 | A | 10/2000 | MacLennan et al. | |
| 6,246,160 | B1 | 6/2001 | MacLennan et al. | |
| 6,252,346 | B1 | 6/2001 | Turner et al. | |
| 6,265,813 | B1 | 7/2001 | Knox et al. | |
| 6,313,587 | B1 | 11/2001 | MacLennan et al. | |
| 6,424,099 | B1 | 7/2002 | Kirkpatrick et al. | |
| 6,566,817 | B2 | 5/2003 | Lapatovich | |
| 6,617,806 | B2 | 9/2003 | Kirkpatrick et al. | |
| 6,621,195 | B2 | 9/2003 | Fuji et al. | |
| 6,666,739 | B2 * | 12/2003 | Pothoven et al. | 445/43 |
| 6,737,809 | B2 | 5/2004 | Espiau et al. | |
| 6,856,092 | B2 | 2/2005 | Pothoven et al. | |
| 6,922,021 | B2 | 7/2005 | Espiau et al. | |
| 7,012,489 | B2 | 3/2006 | Sherrer et al. | |
| 7,034,464 | B1 | 4/2006 | Izadian et al. | |
| 7,291,985 | B2 | 11/2007 | Espiau et al. | |
| 7,348,732 | B2 | 3/2008 | Espiau et al. | |
| 7,358,678 | B2 | 4/2008 | Espiau et al. | |
| 7,362,054 | B2 | 4/2008 | Espiau et al. | |
| 7,362,055 | B2 | 4/2008 | Espiau et al. | |
| 7,362,056 | B2 | 4/2008 | Espiau et al. | |
| 7,372,209 | B2 | 5/2008 | Espiau et al. | |
| 7,391,158 | B2 | 6/2008 | Espiau et al. | |
| 7,429,818 | B2 | 9/2008 | Chang et al. | |
| 2001/0035720 | A1 | 11/2001 | Guthrie et al. | |
| 2002/0180356 | A1 | 12/2002 | Kirkpatrick et al. | |
| 2005/0212456 | A1 | 9/2005 | Espiau et al. | |
| 2005/0286263 | A1 * | 12/2005 | Champion et al. | 362/558 |
| 2006/0250090 | A9 | 11/2006 | Guthrie et al. | |
| 2007/0109069 | A1 | 5/2007 | Espiau et al. | |
| 2007/0171006 | A1 | 7/2007 | DeVincentis | |
| 2007/0211991 | A1 | 9/2007 | Espiau et al. | |
| 2007/0217732 | A1 | 9/2007 | Chang et al. | |
| 2007/0222352 | A1 | 9/2007 | DeVincentis et al. | |
| 2007/0236127 | A1 | 10/2007 | DeVincentis et al. | |
| 2008/0054813 | A1 | 3/2008 | Espiau et al. | |
| 2008/0211971 | A1 | 9/2008 | Pradhan | |

FOREIGN PATENT DOCUMENTS

| | | | |
|---|---|---|---|
| KR | 1020050018587 | A | 2/2005 |
| WO | WO-2006070190 | | 7/2006 |
| WO | WO-2007138276 | | 12/2007 |
| WO | WO-2008048972 | A3 | 4/2008 |
| WO | WO-2008048978 | A2 | 4/2008 |
| WO | WO-2006129102 | | 12/2008 |

OTHER PUBLICATIONS

"Chapter 6.3—Rectangular Waveguide Cavities", in: *Microwave Engineering*, Pozar, D. M., Editor (John Wiley & Sons, Inc.), 313-318.

Espiau, F. M., et al., "Plasma Lamp", U.S. Appl. No. 60/022,028, filed Jul. 31, 2000, 28 pgs.

Guthrie, C., et al., "A Corregated Wave-Guide Used for the Excitation of an Electrode-Less Metal Halide Plasma Lamp Incorporating a Solid Dielectric Material", U.S. Appl. No. 60/224,060, filed Aug. 9 2000, 9 pgs.

Guthrie, C., et al., "A Method for Connecting the Antenna on a Printed Wiring Board to a Wave-Guide in a Light Source in Which an Electrode-Less Lamp is Built into the Wave-Guide Structure", U.S. Appl. No. 60/224,061, filed Aug. 9, 2000, 9 pgs.

Guthrie, C., "D.R.I. Drawings—Wave Guide Lamp Concept 8 (WGC008); Wave Guide Lamp Concept 9 (WGC009); and Wave Guide Lamp Concept 10 (WGC010)", Guthrie Exhibit 2173, Board of Patent Appeals and Interferences (Interference No. 105,393), (Jun. 28, 2000), 3 pgs.

Guthrie, Charles, et al., "Electrodeless Incandescent Bulb", U.S. Appl. No. 60/639,857, filed Dec. 27, 2004, and Don Wilson, 16 pgs.

Guthrie, Charles, "LAMP", U.S. Appl. No. 60/687,458, filed Jun. 6, 2005, 12 pgs.

Guthrie, Charles, et al., "LAMP", U.S. Appl. No. 60/687,280, filed Jun. 3, 2005, and Neate, 17 pgs.

Inventors Not Listed, "LAMP", International Application Serial No. PCT GB2007 001935, International filing date May 24, 2007, GB Application Serial No. 0610580.3, filed May 30, 2006.

Izadian, J. S., et al., "Generating Light From Electromagnetic Energy", U.S. Appl. No. 60/337,057, filed Nov. 6, 2001, 120 pgs.

Pozar, D. M., "Section 5.8, Tapered Lines", In: *Microwave Engineering*, 3rd Edition, 2005 (John Wiley & Sons, Inc), 9 pgs.

Pozar, D. M., "Section 6.4, Circular Waveguide Cavities", in: *Microwave Engineering*, 3rd Edition, 2005 (John Wiley & Sons, Inc.), 8 pgs.

Prior, G., et al., "Quartz Bulb Enclosed in a Wave-Guide", U.S. Appl. No. 60/234,415, filed Sep. 21, 2000, 5 pgs.

Prior, G., et al., "Wave-Guide Used for the Excitation of an Electrode-Less Metal Halide Plasma Lamp Incorporating a Solid Dielectric Material", U.S. Appl. No. 60/224,059, filed Aug. 9, 2000, 7 pgs.

Prior, G., et al., "Wave-Guide Used for the Excitation of an Electrode-Less Metal Halide Plasma Lamp Incorporating a Solid Dielectric Material", U.S. Appl. No. 60/224,298, filed Aug. 10, 2000, 5 pgs.

Sandberg, E., et al., "A Mechanical Means of Sealing the Window to an Electrode-Less Metal Halide Bulb That Is Integrated Into a Waveguide", U.S. Appl. No. 60/262,536, filed Jan. 17, 2001, 6 pgs.

Sandberg, E., "An Improved Drive Circuit for an Electrode-Less Plasma Lamp That Is Embedded in a Waveguide", U.S. Appl. No. 60/241,198, filed Oct. 17, 2000, 7 pgs.

Sandberg, E., "Light Source for Use in Microdisplay Based Light Engines", U.S. Appl. No. 60/192,731, filed Mar. 27, 2000, 31 pgs.

Smoler, D., "E-Mail to C. Guthrie re: Ridged Waveguide Ideas", (Jun. 27, 2000), 2 pgs.

Wharmby, D. O., "Chapter 11—Electrodeless Lamps", in: *Lamps & Lighting*, 4th Edition, 1997 (Arnold & John Wiley & Sons, Inc., 13 pgs.

Wharmby, D. O., "Electrodeless Lamps for Lighting: A Review", *IEEE Proceedings-A*, vol. 140 (6), (Nov. 1993), 9 pgs.

Wilson, D,, et al., "Use of a Coating to Prevent the Reduction of Ceramic to Elemental Metal in the Bulb of a Wave-Guide Lamp", U.S. Appl. No. 60/224,866, filed Aug. 11, 2000, 3 pgs.

Wilson, D., et al., "Electrode-Less Metal Halide Plasma Lamp With Integrated Electronics", U.S. Appl. No. 60/224,290, filed Aug. 10, 2000, 9 pgs.

Wilson, D., et al., "High Temperature, Low Cost Window Sealing Technique for Plasma Lamps", U.S. Appl. No. 60/224,291, filed Aug. 10, 2000, 5 pgs.

Wilson, D., et al., "Light Source Consisting of an Electrode-Less Metal Halide Plasma Bulb That Is Integrated Into a Wave-Guide", U.S. Appl. No. 60/224,289, filed Aug. 10, 2000, 6 pgs.

Wilson, D., et al., "Means to Reduce EMI in a Wave-Guide", U.S. Appl. No. 60/224,503, filed Aug. 10, 2000, 20 pgs.

Wilson, D., et al., "R.F. Wave-Guide Into Which an Insert of a Hermetric Material That Has Been Either Molded or Plasma Deposited", U.S. Appl. No. 60/224,257, filed Aug. 10, 2000, 5 pgs.

Wilson, D., et al., "Use of a Heat Sink in a Plasma Light Source (Located Between a Wave Guide That Incorporates the Bulb and the Drive Electronics", U.S. Appl. No. 60/224,961, filed Aug. 11, 2000, 6 pgs.

Wilson, D., et al., "Use of a Heat Sink in a Plasma Light Source (Located Externally and Surrounding the Lamp Assembly)", U.S. Appl. No. 60/224,617, filed Aug. 11, 2000, 20 pgs.

* cited by examiner

FREQUENCY TUNABLE RESONANT CAVITY FOR USE WITH AN ELECTRODELESS PLASMA LAMP

CROSS REFERENCE TO RELATED APPLICATIONS

This application claims the benefit of priority to U.S. Provisional Application No. 60/888,729, filed on Feb. 7, 2007, the contents of which are incorporated herein by references in their entirety.

BACKGROUND

In manufacturing an electrodeless lamp for consumer televisions, it is advantageous to minimize the production cost of the product. The dielectric resonator at the heart of a plasma lamp has an associated resonant frequency that may be highly sensitive to the resonator dimensions and physical composition. The sensitivity is such that some dimensional deviations within "standard" mechanical tolerances can produce unacceptable deviations in resonant frequency.

BRIEF DESCRIPTION OF THE DRAWINGS

This patent document file contains at least one drawing executed in color. Copies of this patent document in the form of a patent or patent application publication with color drawings will be provided by the Office upon request and payment of the necessary fee.

DETAILED DESCRIPTION

In the following description, for purposes of explanation, numerous specific details are set forth in order to provide a thorough understanding of an embodiment of the present invention. It will be evident, however, to one skilled in the art that the present invention may be practiced without these specific details.

Overview

In order, for example, to avoid component specifications with extremely tight and therefore expensive mechanical tolerances, a tunable system is presented to adjust the frequency of each puck. In an example embodiment, the frequency adjustment is accomplished through a tuning element embedded in the resonator. The change in frequency induced by adjusting the tuning element compensates for deviations away from the nominal frequency that might be caused by other factors such as dimensional or compositional variations.

Example Embodiments

In an example embodiment a technique is provided for tuning the frequency of a resonant cavity for an electrodeless lamp. In this example technique, a solid dielectric tuning element (e.g., a "stub") having a relative permittivity ($\in_r$) (e.g., greater than 10 in an example embodiment) is inserted at a certain depth into a hole in the puck to obtain a certain frequency. The high $\in_r$ of the material, combined with its position within the resonator may then determine the frequency of the structure. If the stub displaces an air cavity inside the resonator in an area that has a relatively high electric field magnitude, it will tend to increase the effective capacitance of the structure, and therefore lower the frequency. If instead, the stub is moved to a part of the resonator that has a relatively low electric field magnitude, leaving the high e-field region air-filled, it will tend to relatively decrease the effective capacitance of the structure, and therefore increase the frequency. The range of frequency tuning can be in the range of several 10's of MHz, which is enough to significantly relax the tolerance requirements on the puck. The extra cost of the tuning element may be more than compensated by the cost reduction from relaxing the tolerances, as well as by yield improvements due to reduced frequency variation.

In prior art plasma lamps, the puck frequency is fixed by a number of factors, including the resonator dimensions, ceramic composition, and operating temperature. No tuning element (variable or otherwise) is used, and the uniformity of frequency that is required to manufacture the product is obtained at great cost through requiring very tight mechanical tolerances on critical dimensions. These systems clearly would have benefited from a tunable element in accordance with the present example embodiment.

Figure 1:
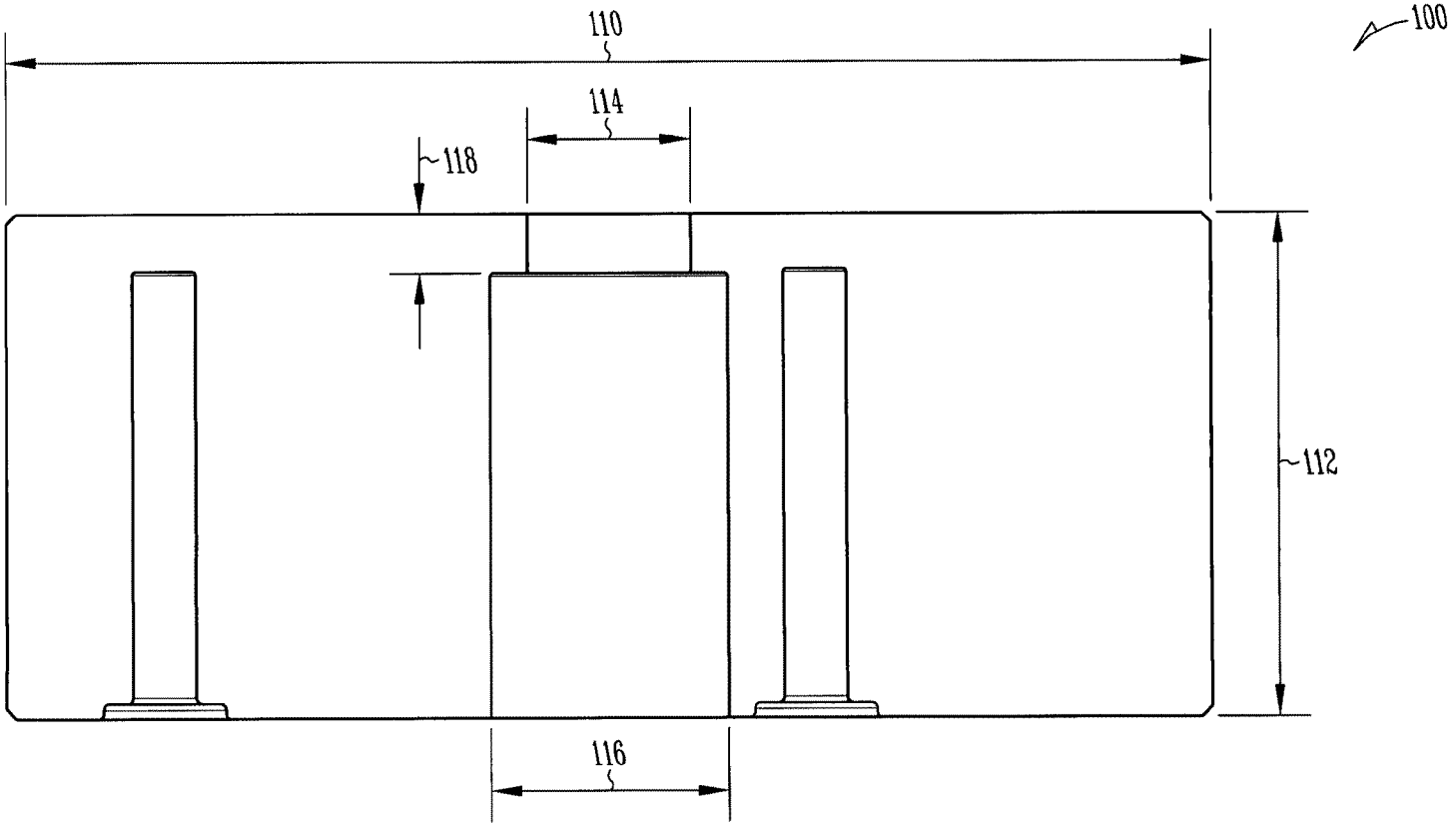
FIG. 1 shows a cross-section of a puck used in an electrodeless plasma lamp (without a tuning element according to an example embodiment)

An example puck 100 and selected dimensions are shown in FIG. 1. An outer diameter 110 of the puck 100 and a height 112 are shown. Also illustrated are the bulb hole diameter 114 and the shelf hole diameter 116. A gap 118 is shown that corresponds to a region near the bulb hole.

Figure 2:
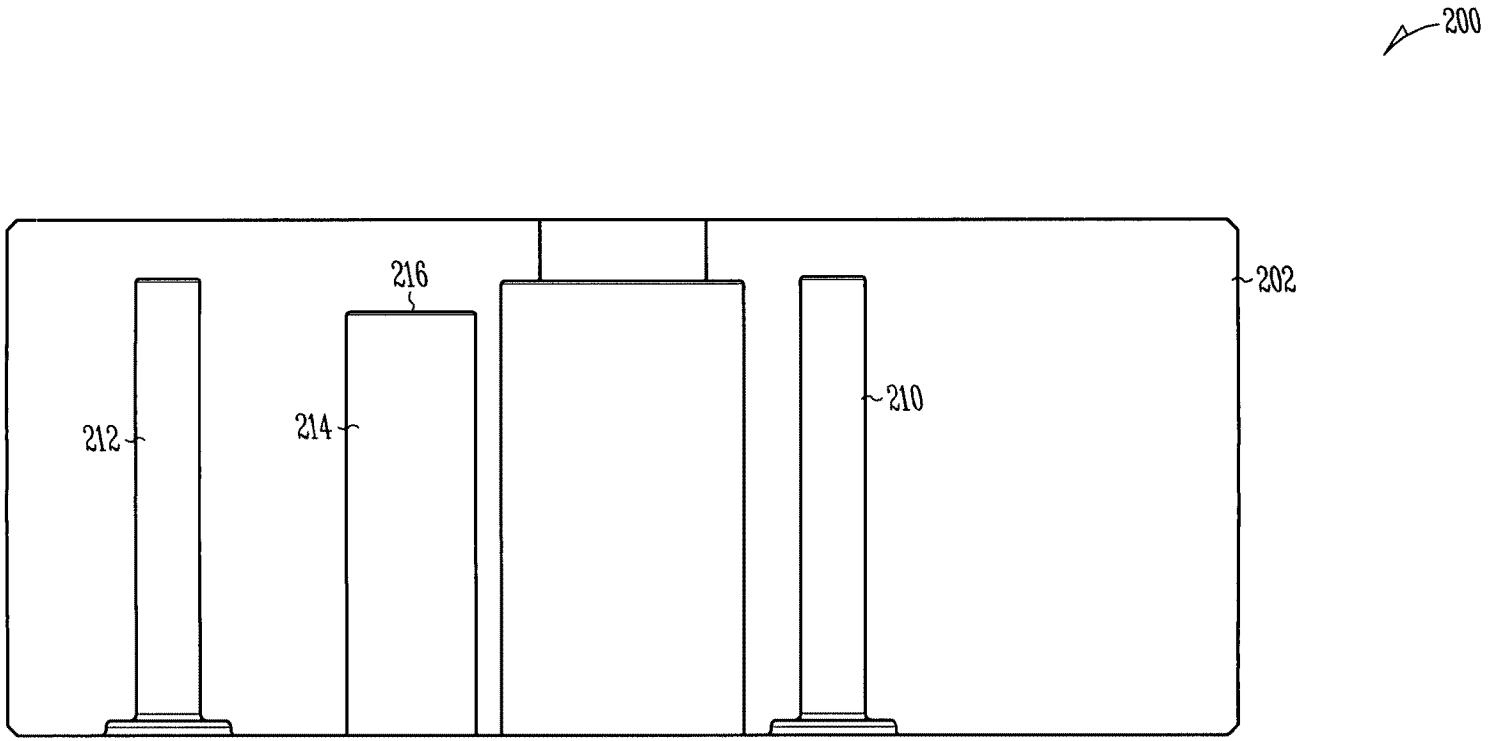
FIG. 2 shows a puck, in accordance with an example embodiment, with an extra hole to house or receive a tuning element.
Figure 3:
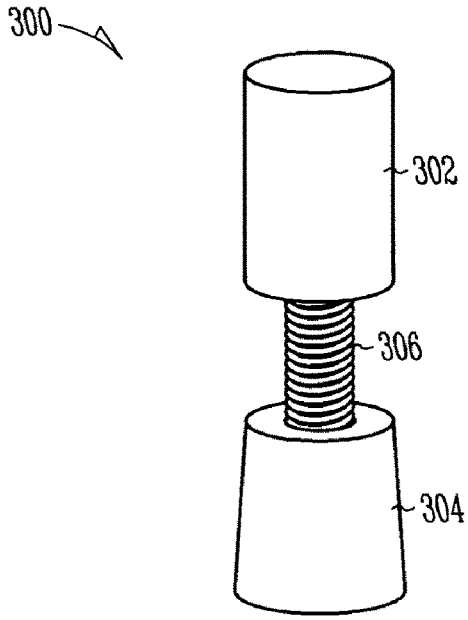
FIG. 3 shows a tuning element in accordance with an example embodiment.
Figure 4A:
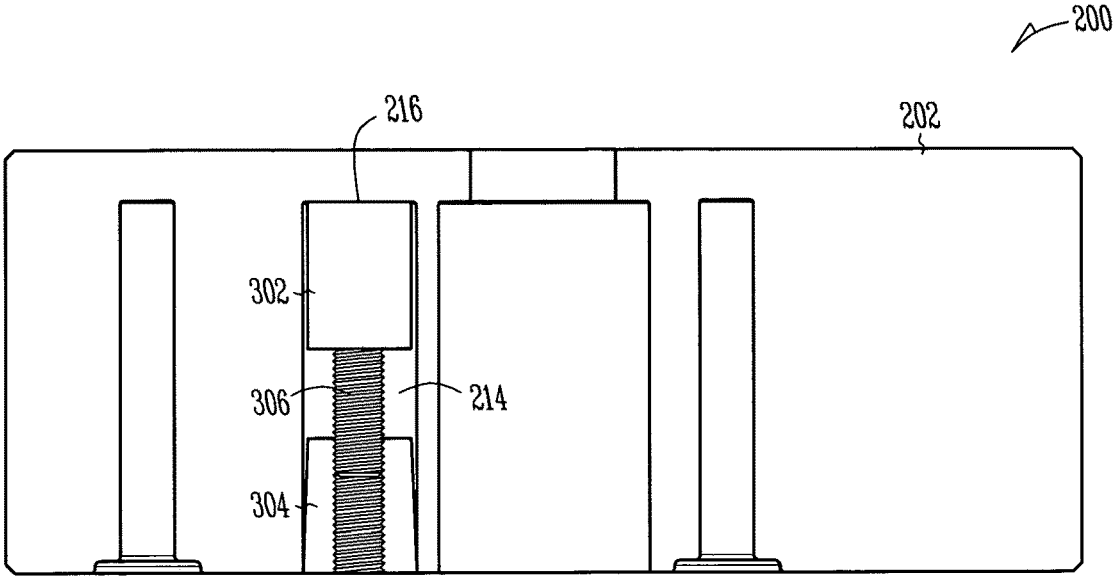
FIG. 4A shows a cross-section showing the tuning element inserted into the puck, and extended to its maximum position in accordance with an example embodiment.
Figure 4B:
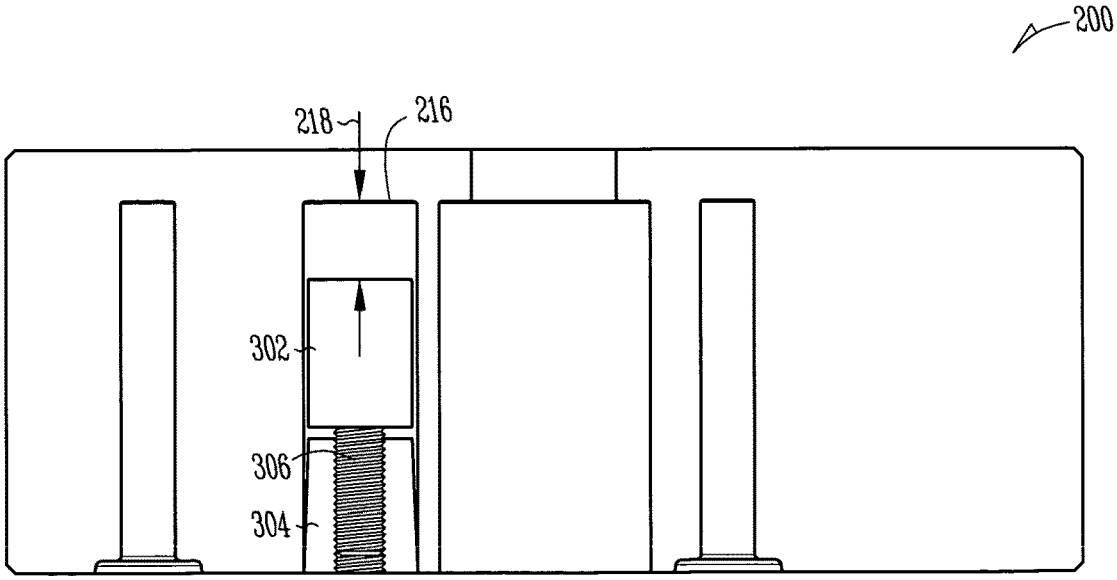
FIG. 4B shows a cross-section showing the tuning element inserted into the puck, and retracted away from its maximum position in accordance with an example embodiment.

In an example embodiment, a standard puck is modified to have an extra hole for fitting the tuning element (see FIG. 2). FIG. 2 shows a puck 200 having a drive probe hole 210 and a feedback probe hole 212, with a tuning element hole 214. The tuning element hole 214 is formed into a side of puck body 202 to a depth 216. In one embodiment, a tuning element 300 is inserted into the tuning element hole 214 as shown in FIGS. 4A and 4B. The tuning element 300 may comprise a dielectric stub 302 mounted on a threaded rod 306, which is screwed into a threaded insert 304 (see FIG. 3). The stub 302 is located in the puck 200 as shown in FIG. 4A-4B. The mechanical holding of the tuning element 300 inside the puck 200 can be accomplished by an interference fit between the metal threaded insert 304 and the puck body 202. Thus an example threaded insert 304 appears in the example embodiment of FIG. 3 with a slightly tapered profile. It will however be appreciated that the tuning element 300 can be mounted or received in any suitable manner within the puck 200. Also, it will be appreciated that the tuning element 300 need not necessarily be fully received with the puck 200 and a portion of it may protrude from the puck 200.

The frequency tuning may be accomplished by turning the threaded rod 306 with an adjustment screwdriver at a resonant frequency test station. The position of the tuning stub 302 is moved in or out of the puck 200 to move the puck frequency down or up, respectively. It should be noted that in other embodiments no threading is provided and other techniques may be used to displace the tuning stub 302 into the puck.

Simulation Results—Example Fixed Tuned Puck

The frequency of a fixed tuned puck may be controlled primarily by five critical dimensions, as given in FIG. 1. The sensitivity of the frequency to changes in each dimension is given in Table 1:

TABLE 1

| Dimension | Frequency: Nominal-Tolerance | Frequency: Nominal | Frequency: Nominal + Tolerance | Tolerance Range | Frequency Range |
|---|---|---|---|---|---|
| Outer Diameter | 920.8 | 918.7 | 916.4 | 0.5 mm | 4.4 MHz |
| Height | 926.7 | 918.7 | 911.9 | 0.5 mm | 14.8 MHz |
| Shelf Hole Diameter | 921.3 | 918.7 | 915.2 | 0.2 mm | 6.1 MHz |
| Bulb Hole Diameter | 916.0 | 918.7 | 920.6 | 0.2 mm | 4.6 MHz |
| Gap | 908.7 | 918.7 | 930.8 | 0.2 mm | 22.1 MHz |

It was found that variations across multiple dimensions produce frequency variations that roughly obey linear superposition. For example, if a puck's outer diameter and height were both at their respective upper specification limits, then the frequency will be lower than nominal by the sum of the expected deviations due to either dimension. Since it is difficult to control five dimensions so tightly, it is imperative that the most sensitive parameter to frequency, the gap, is at least tightly controlled. In order to maintain adequate production yields, it was found necessary to specify the gap tolerance as ±0.02 mm, or an order of magnitude smaller than the range listed in Table 1.

Simulation Results—Example Tunable System

Figure 5A:
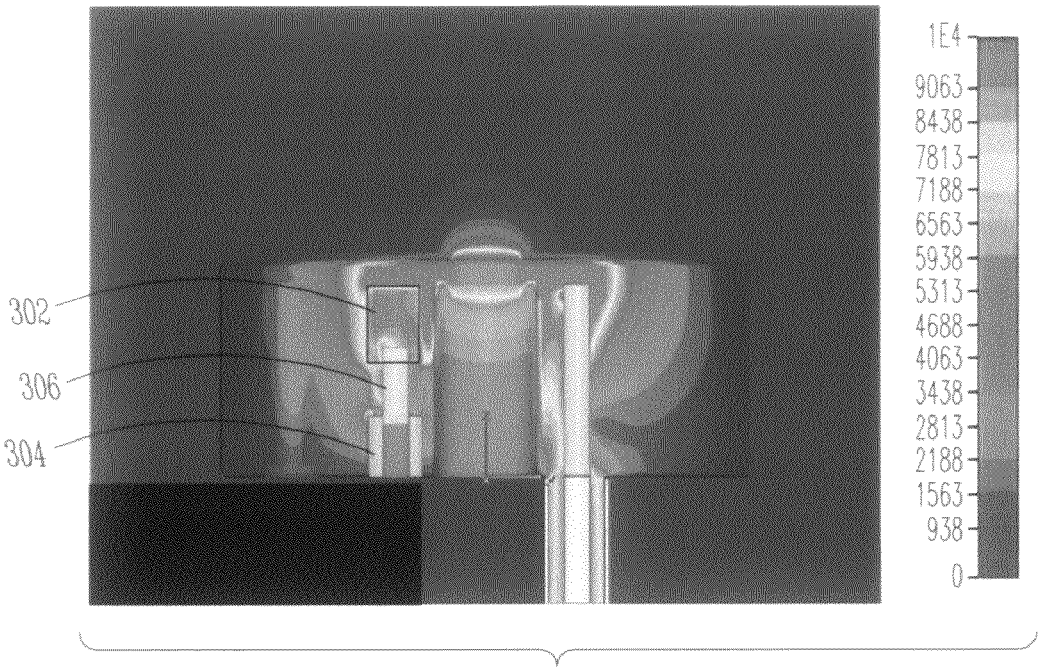
FIG. 5A shows a simulation result showing an electric field magnitude at 918 MHz of the example tunable puck at its low-frequency setting in accordance with an example embodiment.

The lowest attainable frequency is that for which the tuning stub 302 is inserted all the way into the puck 200, as in FIG. 4A. The electric field distribution for this example case is given in FIG. 5A, where the protrusion of the stub 302 into the high e-field region is clearly shown. FIG. 5A illustrates a peak e-field at a resonant frequency of 918 MHz.

Figure 5B:
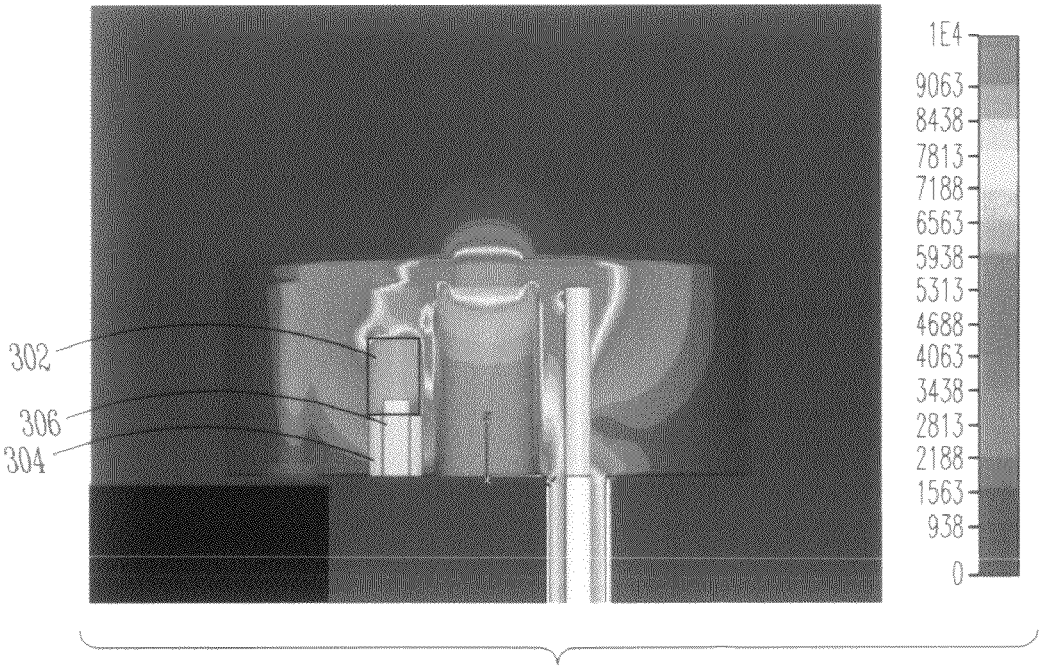
FIG. 5B shows a simulation result showing the electric field magnitude at 937.5 MHz of the example tunable puck at its high-frequency setting in accordance with an example embodiment.

The highest frequency result will be for the case where the parameter 218 (see FIG. 4*b*) is increased as much as possible. The electric field distribution for this example case is given in FIG. 5B, where the stub 302 is shown retracted out of the high e-field region. In FIG. 5B, the peak e-field is at a resonant frequency of 937.5 MHz. Table 2 summarizes the simulation results:

TABLE 2

| Case | Resonant Frequency (MHz) |
|---|---|
| Standard Puck (FIG. 1, Table 1) | 918.7 |
| Tunable Puck, Low Frequency (FIG. 4A) | 918.0 |
| Tunable Puck, High Frequency (FIG. 4B, dimension 216 = 4 mm) | 937.5 |

The tuning range of about 20 MHz in the example embodiment can compensate for variations in the gap dimension, given a modest tolerance range of 0.2 mm on that dimension. It is clear from Table 2 that some slight modification of the nominal puck dimensions is necessary to center the tuning range on the old nominal frequency of 918.7 MHz.

Figure 6:
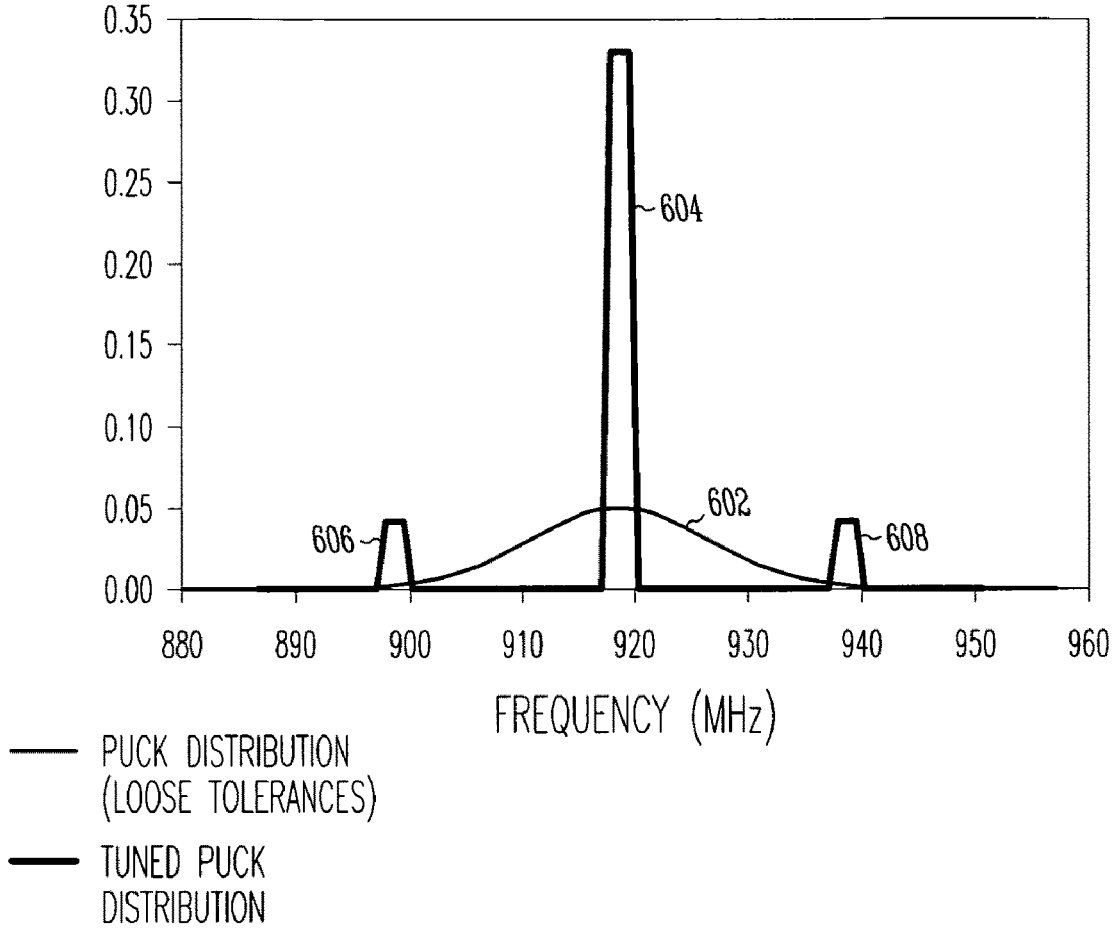
FIG. 6 shows an example frequency distributions before and after tuning, in accordance with an example.

Additionally, the example tuning method allows the puck manufacturer to set the frequency of pucks to several discrete predetermined values. For example, most pucks that are near the center of the frequency distribution can be tuned to the nominal value of 918.7 MHz. The pucks which are at the low end of the frequency distribution can be tuned to a lower target such as 913.7 MHz (nominal−5 MHz), if the tuning range of this method is not adequate to tune them up to 918.7 MHz. Likewise pucks which are at the high end of the frequency distribution can be tuned to a higher target such as 923.7 MHz (nominal+5 MHz). The distribution of pucks before and after tuning may look like FIG. 6, assuming a 20 MHz tuning range and a normal distribution on the nominal design with std.dev.=8 MHz. Distribution 602 indicates an example distribution before tuning, and distribution 604 indicates an example distribution after tuning. Distributions 606 and 608 indicate examples of higher order resonant frequencies that can be tuned as discussed above. Such a discrete distribution may facilitate yield improvement by, for example, (a) reducing frequency variation, and (b) making binning of parts very simple.

Example Electrodeless Plasma Lamp

An electrodeless plasma lamp including a tuning element is described by way of example below.

Figure 7:
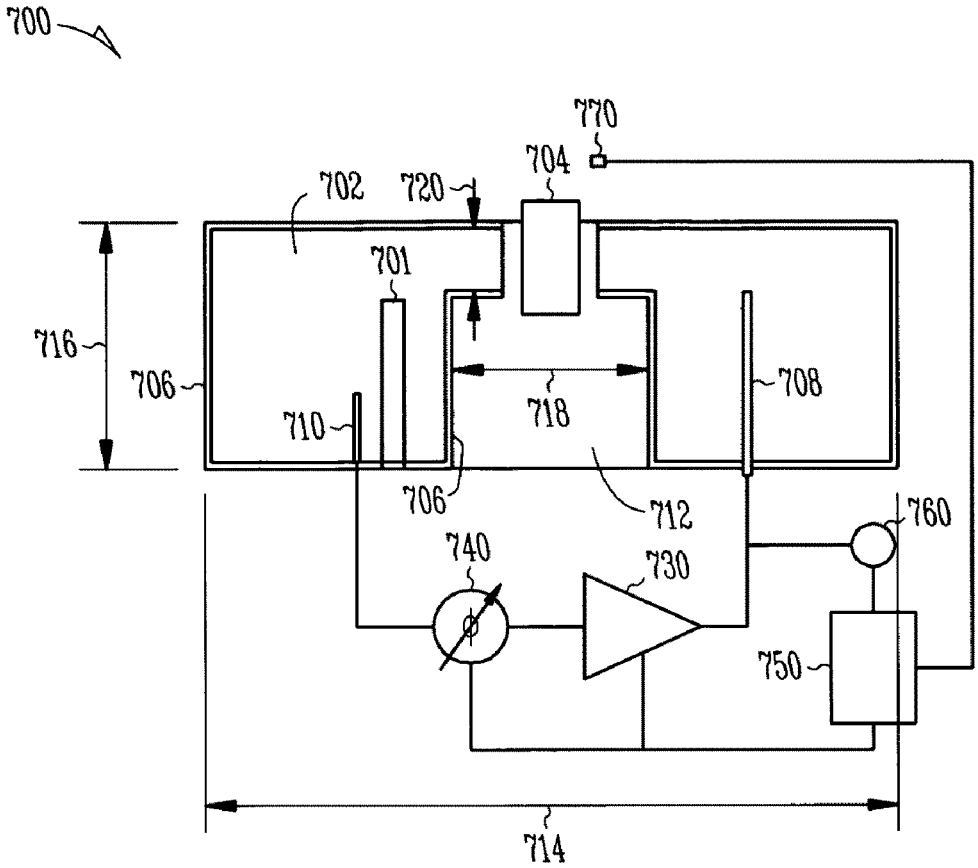
FIG. 7 shows a cross-section and schematic view of a plasma lamp according to an example embodiment that includes a tuning element.

FIG. 7 is a cross-section and schematic view of a plasma lamp 700 according to an example embodiment. As described above, the plasma lamp 700 may include a tuning element 701 such as those described in embodiments above for tuning the frequency of a resonant cavity of the plasma lamp 700. It should be noted that the tuning element may be of any suitable size or shape and that it may be provided at any suitable position in a lamp body 702.

In example embodiments, the plasma lamp may have the lamp body 702 that includes a dielectric material having a dielectric constant greater than about 2. For example, alumina, a ceramic having a dielectric constant (K) of about 9, may be used. In some embodiments, the dielectric material may have a dielectric constant in the range of from 2 to 100 or any range subsumed therein, or an even higher dielectric constant. In some embodiments, the body may include more than one such dielectric material resulting in an effective dielectric constant for the body within any of the ranges described above. The body may be rectangular, cylindrical or other shape as described further below. A bulb 704 may be positioned in a cavity within the lamp body. The bulb 704 may be quartz, sapphire or other desired bulb material and may be cylindrical, pill shaped, spherical or other desired shape. In example embodiments, the bulb may have a width in a range between 2 and 30 mm or any range subsumed therein, a wall thickness in a range between 0.5 and 4 mm or any range subsumed therein, and a length between 2 and 30 mm or any range subsumed therein. These dimensions are examples only and other embodiments may use bulbs having different dimensions.

In example embodiments, the bulb 704 contains a fill that forms a light emitting plasma when radio frequency power is applied to the bulb. The fill may include a metal halide fill, such as indium bromide. Additives such as mercury may also be used. In other embodiments, different fills such as sulfur, selenium or tellurium may also be used. In some examples, a metal halide such as cesium bromide may be added to stabilize a discharge of sulfur, selenium or tellurium.

In example embodiments, the outer surfaces of the lamp body 702 (other than those adjacent to the bulb through which power is coupled to the bulb) may be coated with an electrically conductive coating 706, such as electroplating or a silver paint or other metallic paint which may be fired or otherwise attached onto the outer surface of the lamp body. The electrically conductive materially may be used to establish a boundary condition for radio frequency power applied to the lamp body 702. As shown in FIG. 7, in some embodiments the lamp body 702 forms a narrow region adjacent to the bulb 704. One or both ends of the bulb 704 may protrude from this region of the lamp body 702 in some embodiments to reduce the impact of the plasma on the ends of the bulb.

Lamp 700 has a drive probe 708 (or any other feed (e.g., a PC board feed)) inserted into the lamp body 702 to provide radio frequency power to the lamp body. A power supply, such as amplifier 730, may be coupled to the drive probe to provide the radio frequency power. In example embodiments, radio frequency power may be provided at a frequency in the range of between about 0.1 GHz and about 10 GHz or any range subsumed therein. The radio frequency power may be provided to drive probe 708 at or near a resonant frequency for lamp body 702. The frequency may be selected based on the dimensions and dielectric constant of the lamp body to provide resonance in the lamp body. In example embodiments, the frequency is selected for the fundamental resonant mode of the lamp body, although higher order modes may also be used in some embodiments. The power in the lamp body 702 is coupled to the bulb through the dielectric walls adjacent to the bulb (which are not coated with an electrically conductive material) to produce a light emitting plasma.

Lamp 700 has a feedback probe FP inserted into the lamp body 702 to obtain feedback from the lamp body. The feedback probe FP is coupled to the input of the amplifier 730 through a phase shifter 740. An example phase shifter is the PS214-315 voltage-controlled phase-shifter available commercially from Skyworks Solutions Inc. of Woburn, Mass.

The feedback loop automatically oscillates at a frequency based on the load conditions and phase of the feedback signal. This feedback loop may be used to maintain a resonant condition in the lamp body 702 even though the load conditions change as the plasma is ignited and the temperature of the lamp changes. If the phase is such that constructive interference occurs for waves of a particular frequency circulating through the loop, and if the total response of the loop (including the amplifier, lamp, and all connecting elements) at that frequency is such that the wave is amplified rather than attenuated after traversing the loop, the loop will oscillate at that frequency. In the absence of a phase-shifter, the phase of a wave circulating back to the same point in the loop may depend on the ratio of its wavelength to the loop length (as well as on the dielectric constants of all intervening material).

Therefore, whether a particular setting of the phase-shifter induces constructive or destructive feedback depends on frequency. In this way, the phase-shifter can be used to finely tune the frequency of oscillation within the range supported by the lamp's frequency response. In doing so, it also effectively tunes how well RF power is coupled into the lamp because power absorption is frequency-dependent. Thus, the phase-shifter provides fast, finely-tunable control of the lamp output intensity.

Both tuning and detuning are useful. For example: tuning can be used to maximize intensity as component aging changes the overall loop phase; detuning can be used to control lamp dimming. In some example embodiments, the phase selected for steady state operation may be slightly out of resonance, so maximum brightness is not achieved. This may be used to leave room for the brightness to be increased and/or decreased by the control electronics 750. The amplifier may also have a gain control portion coupled to the control electronics 750. Amplifier 730 may include either a plurality of gain stages or a single stage.

Control electronics 750 may adjust the phase of phase shifter 740 and/or the gain of the amplifier 730 to control the power provided to the lamp body 702. Control electronics 750 can range from a simple analog feedback circuit to a microprocessor/microcontroller with embedded software. In example embodiments, feedback information regarding the lamp's light output intensity is provided either directly by an optical sensor 770, e.g., a photodiode, or indirectly by an RF power sensor 760, e.g., a rectifier.

The power to the lamp body may be controlled to provide a desired startup sequence for igniting the plasma, maintaining a desired resonant frequency during operation of the lamp and/or to modulate the brightness of the lamp. For example, the phase of the phase shifter 740 and/or gain of the amplifier 730 may be modulated. This results in modulation of the power input to the plasma in the bulb 704, so that the intensity of light emitted by the plasma is modulated.

As shown in FIG. 7, a material 712 such as a ceramic material or adhesive may be included around the bulb 704 and in the recess below the bulb 704. In one example, alumina powder may be used. The alumina powder is packed around the bulb and into the recess and is sintered by the heat of the bulb. The alumina powder is outside of the electrically conductive coating 706 of the lamp body. The material 712 may provide reflection from the bulb and/or stability for the thin region of the lamp body 702 near the bulb 704. The material 712 may also be used to manage thermal properties of the lamp, such as conduction of heat from the bulb, and may be in contact with bulb surfaces that extend outside of the lamp body 702. One or more heat sinks (not shown) may also be used around the sides and/or along the bottom surface of the lamp body to manage temperature.

Thermal modeling may be used to select a lamp configuration providing a high peak plasma temperature resulting in high brightness, while remaining below the working temperature of the bulb material. Once a general model is established, the thickness of the thermal layers, positioning of the bulb, heat sinks and air flow around the lamp body/heat sink may also be empirically adjusted to obtain desired lamp operating conditions. For instance, in one example, a design temperature upper limit of 1200° C. was selected for the bulb walls, several hundred degrees cooler than the 1500° C. working temperature of quartz.

Modeling may be performed using thermal modeling software, such as the TAS software package available commercially from Harvard Thermal, Inc. of Harvard, Mass. Like other similar packages, TAS is based on the industry standard SINDA (Systems-Improved Numerical Differentiating Analyzer) code. After specifying via a user interface the geometry, thermal properties, and heat sources/sinks of the system being modeled, mesh generation and numerical solution using a finite-difference algorithm are performed.

The electrically conductive coating 706 on the lamp body allows irregular, complex shaped lamp bodies to be used while allowing the lamp body to have a different shape by including additional dielectric material 712 outside the electrically conductive boundary of the lamp body. The dielectric materials, shape and electrically conductive boundaries of the lamp body may be selected to achieve desired resonant frequencies and field intensity distribution in the lamp body.

Simulations may be performed using software tools such as HFSS, available from Ansoft, Inc. of Pittsburgh, Pa., and FEMLAB, available from COMSOL, Inc. of Burlington, Mass. to determine the desired shape of the lamp body, resonant frequencies and field intensity distribution. The desired properties may then be fine-tuned empirically.

While a variety of materials, shapes and frequencies may be used, the following are some examples. One example embodiment is a lamp having an alumina lamp body 702 that operates at a frequency of about 900 MHz, with an outer diameter 714 of about 41.2 mm and a height 716 of about 17.8 mm. In this example, the recess below the bulb 704 may have a diameter 718 of about 6.15 mm and the thin region adjacent to the bulb 704 may have a height 720 of about 3 mm. Another example embodiment is a lamp having an alumina lamp body 702 that operates at a frequency of about 2.15 GHz, with an outer diameter 714 of about 29.4 mm and a height 716 of about 7.62 mm. In this example, the recess below the bulb 704 may have a diameter 718 of about 6.15 mm and the thin region adjacent to the bulb may have a height 720 of about 3 mm. The above dimensions are examples only. Other embodiments may use different dimensions.

Although the present application have been described with reference to specific example embodiments, it will be evident that various modifications and changes may be made to these embodiments without departing from the broader spirit and scope of the invention. Accordingly, the specification and drawings are to be regarded in an illustrative rather than a restrictive sense.

What is claimed is:

1. A plasma lamp comprising:

a waveguide having a dielectric waveguide body;

a bulb containing a fill capable of forming a plasma, at least a portion of the bulb being located outside of the dielectric waveguide body;

a radio frequency (RF) feed to provide RF power to the dielectric waveguide body;

an RF power source configured to provide power to the waveguide body through the RF feed; and a tuning element at least partially receivable within the waveguide body, the tuning element being comprised at least partially of a dielectric material having a relative permittivity greater than 2, the tuning element being configured to modify a frequency induced in the waveguide body.

2. The plasma lamp of claim 1, wherein the waveguide body is a resonant cavity.

3. The plasma lamp of claim 1, wherein the tuning element is solid dielectric tuning element.

4. The plasma lamp of claim 1, wherein the tuning element comprises a dielectric stub mounted on a threaded rod, which is screwed into a threaded insert.

5. The plasma lamp of claim 1, wherein the dielectric waveguide body is comprised of a material having a relative permittivity greater than 2.

6. The plasma lamp of claim 1, wherein the dielectric material at least partially comprising the tuning element has a relative permittivity greater than 10.

7. A plasma lamp comprising:

a waveguide having a dielectric waveguide body;

a bulb containing a fill capable of forming a plasma, at least a portion of the bulb being located outside of the dielectric waveguide body;

a radio frequency (RF) feed to provide RF power to the dielectric waveguide body;

a power source configured to provide power to the waveguide body through the RF feed;

a cavity formed within the dielectric waveguide body; and an adjustable insert located at least partially within the cavity, wherein the adjustable insert is movable to vary a dielectric constant distribution within the dielectric waveguide body and modify a frequency induced in the waveguide body.

8. The plasma lamp of claim 7, wherein the adjustable insert includes a dielectric plug.

9. The plasma lamp of claim 7, wherein the adjustable insert includes a cylinder, and the cavity includes a corresponding cylindrical hole.

10. The plasma lamp of claim 7, wherein the dielectric waveguide body is comprised of a material having a relative permittivity greater than 2.

11. The plasma lamp of claim 7, wherein the dielectric material at least partially comprising the tuning element has a relative permittivity greater than 10.

12. A method including:

manufacturing a first plasma lamp, including a dielectric waveguide body that houses a bulb, at least a portion of the bulb being located outside of the dielectric waveguide body, the waveguide body having a relative permittivity greater than 2;

forming a tuning element at least partially receivable within the waveguide body, the tuning element having a relative permittivity greater than 10; and adjusting the tuning element in the first plasma lamp to provide the first lamp to have a first resonant frequency.

* * * * *